US005160646A

United States Patent [19]

Scheld

[11] Patent Number: 5,160,646

[45] Date of Patent: * Nov. 3, 1992

[54] PTFE OIL COATING COMPOSITION

[75] Inventor: John L. Scheld, Wayne, N.J.

[73] Assignee: Tribophysics Corporation, Wayne, N.J.

[ * ] Notice: The portion of the term of this patent subsequent to Oct. 22, 2008 has been disclaimed.

[21] Appl. No.: 97,272

[22] Filed: Sep. 17, 1987

Related U.S. Application Data

[63] Continuation of Ser. No. 716,935, Mar. 28, 1985, abandoned, which is a continuation-in-part of Ser. No. 220,654, Dec. 29, 1980, abandoned.

[51] Int. Cl.[5] ..... C10M 111/04

[52] U.S. Cl. ..... 252/32.5; 252/58

[58] Field of Search ..... 252/58, 32.5

[56] References Cited

U.S. PATENT DOCUMENTS

| | | | |
|---|---|---|---|
| 3,202,626 | 8/1965 | FitzSimmons et al. | 524/147 |
| 3,247,116 | 4/1966 | Reiling | 252/58 |
| 4,096,079 | 6/1978 | Pardee | 252/58 |
| 4,224,173 | 9/1980 | Reick | 252/52 A |

*Primary Examiner*—Jacqueline Howard

*Attorney, Agent, or Firm*—James Creighton Wray

[57] ABSTRACT

The present invention relates to a non-aqueous coating composition having solid lubricant particles. A low specific gravity oil coats the particles to lower the specific gravity of the particles. A high specific gravity oil disperses the coated particles. The high specific gravity oil is high relative to the low specific gravity oil. The coating of the low specific gravity oil acts as a buoyant medium to suspend the particles in the high specific gravity oil, which acts as a carrier medium. A chlorinated solvent vehicle constitutes 20 to 90 percent of the entire composition.

20 Claims, No Drawings

PTFE OIL COATING COMPOSITION

BACKGROUND OF THE INVENTION

This is a continuation-in-part of application Ser. No. 220,654 filed Dec. 29, 1980, by John L. Scheld.

This invention relates generally to lubricants and more particularly has reference to lubricants containing a dispersion of solid lubricant particles.

Pertinent United States and foreign patents are found in Class 252, subclasses 60 and 58 and in Class 585, subclass 12 of the Official Classification of Patents in the United States Patent and Trademark Office.

Examples of pertinent patents are U.S. Pat. Nos.

| | | |
|---|---|---|
| 2,510,112 | 3,159,557 | 3,194,762 |
| 3,314,889 | 3,432,431 | 3,493,513 |
| 3,505,229 | 3,536,624 | 3,640,859 |
| 3,723,317 | 3,933,656 | 4,029,870 |
| 4,127,491 | 4,224,173. | |

U.S. Pat. No. 4,224,173 describes an eight step method for making lubricant oil containing polytetrafluoroethylene particles and a fluorochemical surfactant.

U.S. Pat. No. 2,510,112 describes an aqueous dispersion of colloidal polymerized polytetrafluoroethylene in a fluorinated hydrocarbon oil.

U.S. Pat. No. 3,194,762 describes a product having resin particles suspended in an oil base.

U.S. Pat. No. 3,159,557, 3,432,431, 3,493,513, 3,505,229, 3,630,901, and 3,640,859 describe greases containing polytetrafluoroethylene particles.

U.S. Pat. No. 3,723,317 describes a grease wherein triazene is combined with polytetrafluoroethylene to thicken a fluorinated polyether base oil.

U.S. Pat. No. 4,029,870 describes unsintered polytetrafluoroethylene which has been irradiated.

U.S. Pat. No. 3,933,656 describes sub-micron polytetrafluoroethylene particles.

U.S. Pat. No. 4,127,491 describes an aqueous dispersion of polytetrafluoroethylene particles.

The benefits of solid particle lubricant additives have been recognized for some time. Tests indicate varying but consistent improvements in engine efficiency through the use of molybdenum disulfide and graphite. The effects of solid particles as a cushion between sliding metal parts having been established, the natural tendency is to develop improved or advanced products. Polytetrafluoroethylene has been introduced as a solid particle additive that exhibits the same cushioning effects as molybdenum disulfate and graphite, but with the advantage of being a cleaner material to work with and a better or lower friction lubricant.

However, there are several problems associated with the use of polytetrafluoroethylene particle additives.

The preparation of a stable dispersion through chemical stabilization of polytetrafluoroethylene is a complex and exacting science. One such stabilization technique is described in U.S. Pat. No. 4,127,491.

Moreover, the dispersion achieved by the chemical stabilization method is short-lived. Upon standing for short periods of time, the particles settle and develop what could be called a "hard settle", i.e., the particles cannot be redispersed.

Added to the "hard settling" problem are the in-service problems of short-lived effectiveness. The apparent problem with dispersions achieved by the chemical stabilization method is that the surface active materials and film forming polymers become ineffective after a brief period of use.

SUMMARY OF THE INVENTION

The present invention overcomes many of the problems which exist in the prior art.

In the present invention, sintered and ground solid lubricant, preferably PFA (perfluorinated alkoxy), FEP (fluorinated ethylene prophylene) or PTFE (polytetrafluoroethylene) particles are physically dispersed in a tricresyl phosphate carrier medium. The particles are pre-wet with aliphatic naphtha and are coated with 10 to 70 weight oil having a low miscibility in tricresyl phosphate and a lower specific gravity than tricresyl phosphate. The diameter of the particles is in the range of about 0.5 microns to about 20 microns.

The coating of the present invention is formed by mixing the pre-wet polytetrafluoroethylene particles with the 50 weight oil at high speed under vacuum. Mixing continues about 30 minutes. The tricresyl phosphate is then added and the resultant mixture is sheared at high speed under vacuum about 15 minutes. Chlorinated solvent is added.

The present invention is useful as a dip, spread or as a spray-on coating.

One object of the invention is, therefore, to provide an improved coating.

Another object of the invention is to provide a coating containing a dispersion of solid lubricant particles.

Yet another object of the invention is to provide a coating containing a dispersion of polytetrafluoroethylene particles.

Still another object of the invention is to provide an improved spray-on coating.

Another object of the invention is to provide a coating comprising solid lubricant particles in a carrier medium, said particles being coated with a buoyant medium having lower specific gravity than the carrier medium and a chlorinated solvent.

Yet another object of the invention is to provide a composition of matter comprising polytetrafluoroethylene particles in a tricresyl phosphate carrier medium.

Still another object of the invention is to provide a method for reducing the apparent specific gravity of particles comprising coating the particles with a material having a relative low specific gravity.

A further object of the invention is to provide a lubricating composition comprising solid lubricant particles in combination with tricresyl phosphate carrier medium and a chlorinated solvent.

Another object of the invention is to provide a method of dispersing solid particles in lubricating oil comprising dispersing said particles in a tricresyl phosphate carrier medium to form an oil additive, and combining said additive with said oil.

Another object of the invention is to provide a method of wetting polytetrafluoroethylene material comprising coating said material with aliphatic naphtha.

Another object of the invention is to provide wetted polytetrafluoroethylene material comprising polytetrafluoroethylene material coated with aliphatic naphtha.

Still another object of the invention is to provide a method of making a stable dispersion comprising combining particles with a buoyant medium to form a first combination, subjecting the first combination to an atmosphere drawn to substantially vacuum, mixing the first combination at high speed in said atmosphere, combining the mixed first combination with the carrier medium to form a second combination, subjecting the second combination to an atmosphere drawn to substantially vacuum, and shearing the second combination at high speed in said atmosphere and adding a chlorinated solvent.

These and other and further objects and features of the invention are apparent in the disclosure which includes the above and below specification and claims.

DETAILED DESCRIPTION OF THE INVENTION

This invention is directed to the formation of a coating which is primarily useful as a dip or spread coating and which can also be used as a spray-on coating to reduce ice formation and drag on surfaces.

The lubricant of the present invention has ground and sintered polytetrafluoroethylene particles physically dispersed in a carrier medium. Such a dispersion was heretofore thought to be impossible because of the high specific gravity of polytetrafluoroethylene.

The theory of creating the suspension in the present invention is relatively straightforward. Heavy particles, such as polytetrafluoroethylene particles, are coated with a relatively low specific gravity buoyant medium, thus lowering the apparent specific gravity of the particles. The coated particles are then floated in a relatively high specific gravity carrier medium. The resulting dispersion will stand for months and will not become solid or difficult to redisperse.

Ground polytetrafluoroethylene particles are used because of their durability and because of their inertness and electrostatic neutrality. The latter characteristics keep the particles from agglomerating.

The use of sintered polytetrafluoroethylene particles reduces the possibility of low boiling polytetrafluoroethylene particles being introduced to the combustion process of an engine. Sintered particles also have smoother surfaces and a more uniform geometry than the non-sintered particles used in the prior art.

The polytetrafluoroethylene particles used in the present invention are generally larger than the particles used in the prior art. The maximum particle size is determined by the intended use of the lubricant. For use on surfaces, the particles must be of sufficient size to bind to the surfaces. Preferably, the particles have a diameter of below 7 microns for about 90% of the particles. Particles at the upper ends of the useful ranges are more difficult to keep dispersed.

Polytetrafluoroethylene particles manufactured by LNP Corporation of Philadelphia, Pa., under the designation TL 102 are particularly suited to the present invention.

Preferably, the particles make up about 2 percent to about 25 percent of the volume of the lubricant.

Efforts to calculate the buoyant effect of the low specific gravity medium on the basis of surface area vs. particle mass prove to be no more accurate than the empirically derived method of adding more low specific gravity medium than is necessary and allowing it to rise to the top of the dispersion when it is mixed with the high specific gravity medium. It is important to use a low specific gravity medium that has low miscibility in the high specific gravity medium, and to start by adding to the miscibility point.

Tricresyl phosphate is particularly useful as the high specific gravity medium of the present invention. Tricresyl phosphate has been used for many years as a high pressure lubricant additive in greases, oils and gasoline. In addition to its lubricant properties, tricresyl phosphate tends to attach to scarred places in a cylinder wall, for example, and prevents further abrasion in that area. This is an extremely beneficial phenomenon and tests by NASA have shown oil life extended to 20,000 miles through the use of tricresyl phosphate additives.

EXAMPLE

Shell Oil Company's aviation grade 10 to 70 w. oil is the preferred low specific gravity medium used in the present invention. That oil was selected primarily because of its low specific gravity and high quality.

Agglomeration can be further prevented in the present invention by pre-wetting the polytetrafluoroethylene particles. Preferably, particles are pre-wet with aliphatic naphtha. Aliphatic naphtha is particularly useful because it wets out instantly, prohibits any agglomeration, breaks up any agglomeration that may already be present, and does not break down in oil. The wetted particles are preferably precoated with olefin copolymer, such as Texaco's TLA-510A.

A method for making the lubricant of the present invention can now be described.

The polytetrafluoroethylene particles are ground and sintered. The resulting powder is pre-wet and precoated.

The low specific gravity oil is then added to the coated wetted powder. That mixture is then placed in a vacuum drawn at least 29.8 inches at standard barometric pressure of 29.92 inches. While the vacuum is being drawn, the mixture is blended at high speed. Preferably, the high speed mixing is at least 4,000 rpm. The mixing can be conveniently carried out in a standard dispersion mixer. A homogenizer is convenient.

50 gallon quantities of the mixture will usually require 30 minutes of mixing and vacuum.

Tricresyl phosphate is then added and the resultant mixture is sheared and vacuumed for 15 minutes.

The end product is a stable dispersion. The excess low specific gravity oil will migrate to the top of the dispersion because it is lighter than the oil coated particles and the tricresyl phosphate.

A sample formula would be as follows:

| | | Range of Parts by Weight in Oil Component |
|---|---|---|
| polytetrafluoroethylene | 3 grams | 1-50 |
| aliphatic naphtha | 3 grams | 1-100 |
| olefin copolymer | 2 grams | 1-40 |
| Shell aviation grade 50 weight oil | 1.8 fluid ounces | 1-100 |
| tricresyl phosphate | 2.0 fluid ounces | 1-100 |

Vehicle or solvent component about 20% to 90% of entire composition. A lubricant made according to that formula is particularly useful as a lubricating or portective coating.

A suitable vehicle or solvent is a reduced aromatic and preferably a straight aliphatic hydrocarbon solvent. Preferably, a chlorinated solvent is used. The preferred solvent is 1,1,1 trichloroethane or Dow CHLOROTHANE VG.

Wehn the lubricant of the present invention is used as a spray-on coating, it is preferred that the lubricant and a propellant be combined in a pressurized valved container in a ratio of about 1:19 by volume. However, that ratio can be changed without departing from the present invention.

In the present invention "lubricant" means a lubricating or a protecting coating.

It is not necessary that the lubricant be applied to surfaces by spraying. The lubricant can be applied to a surface in any manner such as rubbing, painting or dripping or in any other conventional manner.

While the invention has been described with reference to a specific embodiment, the exact nature and scope of the invention is defined in the following claims.

I claim:

1. A non-aqueous coating composition consisting essentially of, solid lubricant particles, a low specific gravity oil coating the particles to lower the specific gravity of the particles, a high specific gravity oil having the coated particles dispersed therein, wherein the high specific gravity oil is high relative to the low specific gravity oil, whereby the coating of low specific gravity oil acts as a buoyant medium to float the particles in the high specific gravity oil which acts as a carrier medium, and a chlorinated solvent vehicle which constitutes 20 percent to 90 percent of the entire composition.

2. The lubricant of claim 1 wherein the solid lubricant particles comprise polytetrafluoroethylene particles.

3. The lubricant of claim 1 wherein the solid lubricant particles comprise sintered polytetrafluoroethylene particles.

4. The lubricant of claim 1 wherein the solid lubricant particles comprise ground polytetrafluoroethylene particles.

5. The lubricant of claim 2 wherein the polytetrafluoroethylene particles are ground to a size in the range of about 0.5 microns to about 20 microns.

6. The lubricant of claim 5 wherein the polytetrafluoroethylene particles are ground to a size of about 5 microns.

7. The lubricant of claim 1 wherein the solid lubricant particles comprise ground and sintered polytetrafluoroethylene particles.

8. The lubricant of claim 1 wherein the buoyant medium has a low miscibility in the carrier medium.

9. The lubricant of claim 1 wherein the concentration of buoyant medium in the carrier medium is at least at the miscibility point.

10. The lubricant of claim 1 wherein the buoyant medium comprises 10 w. to 50 w. oil.

11. The lubricant of claim 1 wherein the carrier medium comprises tricresyl phosphate.

12. The lubricant of claim 1 wherein the solid lubricant particles comprise ground and sintered polytetrafluoroethylene particles, the buoyant medium comprises 10 w. to 70 w. oil, and the carrier medium comprises tricresyl phosphate.

13. The lubricant of claim 1 wherein the solid lubricant particles are pre-wet with a wetting agent.

14. The lubricant of claim 13 wherein the wetting agent comprises aliphatic naphtha.

15. The lubricant of claim 13 wherein the wetting agent comprises $C_8$ to $C_{15}$ isoparafinic liquid.

16. The lubricant of claim 1 wherein the concentration of solid lubricant particles in the lubricant is in the range of about 2 percent to about 15 percent by volume of the oil component.

17. The lubricant of claim 1 wherein said combination of particles, carrier medium and buoyant medium is further combined with a propellant under pressure in a valved container.

18. The lubricant of claim 17 wherein the concentration of propellant in said container is about 95 percent by volume of the oil component.

19. A composition of claim 1 wherein the vehicle comprises 1,1,1 trichloroethane.

20. The composition of claim 19 wherein the 1,1,1 trichloroethane comprises Dow CHLOROTHENE VG.

* * * * *